US011371778B2

(12) United States Patent
Vandamia

(10) Patent No.: US 11,371,778 B2
(45) Date of Patent: Jun. 28, 2022

(54) SHOULDER PAD DRYER AND HANGER

(71) Applicant: Christopher Vandamia, Eighty Four, PA (US)

(72) Inventor: Christopher Vandamia, Eighty Four, PA (US)

( * ) Notice: Subject to any disclaimer, the term of this patent is extended or adjusted under 35 U.S.C. 154(b) by 64 days.

(21) Appl. No.: 16/897,032

(22) Filed: Jun. 9, 2020

(65) Prior Publication Data

US 2021/0116177 A1 Apr. 22, 2021

Related U.S. Application Data

(60) Provisional application No. 62/923,027, filed on Oct. 18, 2019.

(51) Int. Cl.
*F26B 25/18* (2006.01)
*D06F 59/02* (2006.01)

(52) U.S. Cl.
CPC ..... *F26B 25/18* (2013.01); *D06F 59/02* (2013.01)

(58) Field of Classification Search
CPC ..... F26B 25/18; F26B 21/006; F26B 21/004; F26B 21/00; F26B 21/001; F26B 9/003; D06F 59/02
USPC ..... 34/239, 104, 413
See application file for complete search history.

(56) References Cited

U.S. PATENT DOCUMENTS 5,778,556 A * 7/1998 Ohsugi ..... A47L 23/20 34/106
5,946,814 A * 9/1999 Farrant ..... A47L 23/205 34/103
6,796,053 B2 9/2004 Lurie
9,803,314 B1 10/2017 Zupnick
2006/0054576 A1* 3/2006 Durham ..... F26B 25/06 211/85.7
2006/0226177 A1* 10/2006 McJunkin ..... D06F 59/02 223/85
2007/0164062 A1 7/2007 Clopton et al.
2008/0173679 A1 7/2008 McNeely et al.
2015/0289747 A1* 10/2015 McCartney ..... A47G 25/0685 34/103

* cited by examiner

*Primary Examiner* — John P McCormack
(74) *Attorney, Agent, or Firm* — Boudwin Intellectual Property; Daniel Boudwin

(57) ABSTRACT

A shoulder pad dryer and hanger is shown and described. The shoulder pad dryer and hanger includes a central support. The central support has a pair of cross supports connected opposite each other. The central support and the pair of cross supports are hollow such that air flows through the interior of the device. The central support and the pair of cross supports have apertures therein to allow air to pass therethrough. There is a hook located at the top of the central support. At the bottom of the central support there is a fan to force air through the device. There is a shoulder pad support system attached to each of the cross supports that will keep shoulder pads suspended from the device allowing air to flow beneath the pads.

15 Claims, 6 Drawing Sheets

SHOULDER PAD DRYER AND HANGER

CROSS REFERENCE TO RELATED APPLICATIONS

This application claims the benefit of U.S. Provisional Application No. 62/923,027 filed on Oct. 18, 2019. The above identified patent application is herein incorporated by reference in its entirety to provide continuity of disclosure.

BACKGROUND OF THE INVENTION

The present invention relates to a shoulder pad drying device. More particularly, the present invention provides a hanger that will enable a user to dry sports shoulder pads.

Contact sports such as football require the use of protective padding. The protective padding is typically worn under the outer garments of the player. Because the protective padding is enclosed between the outer garment and the under garments of the player, the protective padding quickly builds up heat and absorbs perspiration as the player exerts themselves physically. Over continued use, the combination of high temperatures and absorbed perspiration can cause the protective padding to have an unpleasant odor. If left untreated, such an odor can worsen to the point where the protective padding becomes unusable.

Due to the bulky nature of some protective padding, such as shoulder pads, for example, it is difficult to wash and dry the shoulder pads in a typical consumer washing machine and dryer. The shoulder pads are often hung up to air out and dry. However, merely hanging the shoulder pads to dry is oftentimes not enough to remove all traces of absorbed perspiration. The shoulder pads are often needed for use again before they have time to dry out completely. The new perspiration added to the still retained perspiration can worsen the smell of the shoulder pads. In light of these difficulties, it is desirable to provide a shoulder pad hanger that includes a forced air drying mechanism, such that the shoulder pads can be easily hung for storage and completely dried in a quick and efficient manner, thereby preventing the buildup of bacteria and unwanted odors.

Consequently, there is a need for an improvement in the art of handling sporting equipment. The present invention substantially diverges in design elements from the known art while at the same time solves a problem many people face when having to use the same sporting equipment every day. In this regard the present invention substantially fulfills these needs.

SUMMARY OF THE INVENTION

The present invention provides a shoulder pad drying device wherein the same can be utilized for providing convenience for the user when needing to wear the same equipment everyday while at the same time perspiring during use of the equipment. The shoulder pad drying and hanging device is comprised of a central support connected to a pair of cross supports extending from opposing sides of the central support. The central support and the cross supports are hollow allowing airflow. A pad support system secured to each of the pair of cross supports. The pad support system will allow air to flow between the pad support system and the pair of cross supports. There is a hook protruding from a top of the central support.

Another object of the shoulder pad drying device is to provide a series of apertures located through the central support and the pair of cross supports to allow air flow.

Another object of the shoulder pad drying device is to provide a fan secured to a bottom of the central support.

Another object of the shoulder pad drying device is to provide a hook that is hingedly connected to the central support.

Another object of the shoulder pad drying device is to provide a pad support system that is made from brass.

Another object of the shoulder pad drying device is to provide a pad support system that is made from steel coated in plastic.

Another object of the shoulder pad drying device is to provide a power source electrically coupled to the fan.

Another object of the shoulder pad drying device is to provide a pad support system that is a web configuration.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

LIST OF REFERENCE NUMERALS

Figure 1:
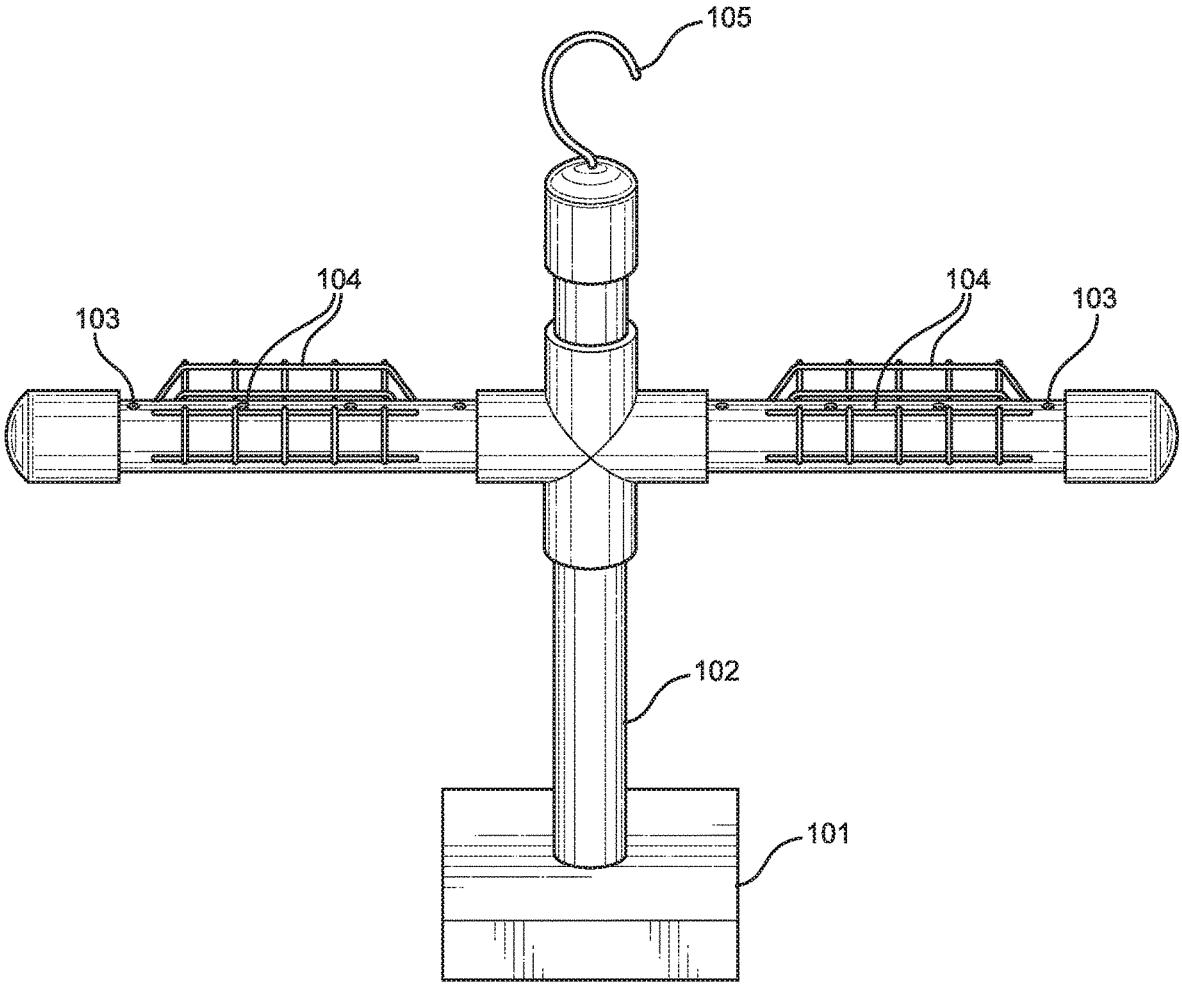
FIG. 1 shows a side view of an embodiment of the shoulder pad drying and hanging device.

With regard to the reference numerals used, the following numbering is used throughout the drawings.

| |
|---|
| 101 Base |
| 102 Central support |
| 103 Cross supports |
| 104 Pad support system |
| 105 Hook |
| 201 Apertures |
| 301 Air flow |
| 302 Fan |
| 303 Fan controls |
| 401 Webbing |
| 401a Steel |
| 401b Plastic coating |
| 402 Supports |
| 501 Air pump |
| 601 Shoulder pads |
| 601a Base of the shoulder pads |
| 601b Shoulder pad neck opening |
| 602 Cage |

DETAILED DESCRIPTION OF THE INVENTION

Reference is made herein to the attached drawings. Like reference numerals are used throughout the drawings to depict like or similar elements of the shoulder pad dryer and hanger. For the purposes of presenting a brief and clear description of the present invention, a preferred embodiment will be discussed as used for the shoulder pad dryer and hanger. The figures are intended for representative purposes only and should not be considered to be limiting in any respect.

Referring now to FIG. 1, there is shown a side view of an embodiment of the shoulder pad drying and hanging device. In one embodiment, the shoulder pad drying and hanging device is comprised of a base 101. In the shown embodiment, the base 101 is a planar square base 101. In other embodiments, the base 101 is comprises other geometric shapes. In some embodiments, the base 101 is not a planar base, but has a vertical dimension as well. In one embodiment, the base 101 is a weighted base. This will hold the drying device up from the base 101 when placed on a surface.

The shoulder pad drying and hanging device is further comprised of a central support 102. The central support 102 rises from the base 101 in a vertical manner when the base 101 is upright. In one embodiment, the central support 102 is configured to be longer than a height of a pair of sport shoulder pads. For, example, and in no way limiting, a pair of sport shoulder pads may be 12 inches from a base to the top of a neck opening. In this example, the central support may be 16 inches in length. See the description of FIG. 6 for a further description.

There is a hook 105 secured to an end of the central support 102 opposite the base 101. The hook 105 is configured to enable the device to be suspended from a closet hanging bar for example. In one embodiment, the hook 105 is fixedly attached to the top of the central support 102. In another embodiment, the hook 105 is connected to the end of the central support 102 such that it is able to rotate about a longitudinal axis of the central support 102. In yet a further embodiment, as described in FIG. 5, the hook 105 is hingedly attached to the central support 102.

The central support 102 is connected to a pair of cross supports 103. The cross supports 103 are positioned such that they are connected opposite each other on the central support 102 extending away from the base 101. In one embodiment, the pair cross supports 103 are connected at a height where the base of the shoulder pads will not extend past the base 101 when placed on the hanger device. See the description of FIG. 6 for a further description.

Each one of the pair of cross supports 103 has at least one pad support system 104 secured thereto. The at least one pad support system 104 will allow for air to flow between the cross supports 103 and the shoulder pads. In the shown embodiment, the pad support system 104 is comprised of two wire ladder structures located on each cross support 103, such that each wire ladder structure includes a pair of parallel longitudinal members and a plurality of lateral members extending between the longitudinal members. The wire ladder structure provides an enlarged support area to a typical single-wire hanger. This allows items such as a shoulder pads which are heavier and bulkier than typical garments to be supported elevated above the cross supports 103 for adequate airflow, while being steadily supported on the larger surface area provided by the ladder structure. In one embodiment, the pad support system 104 is made from brass. Brass will prevent corrosion from sweat, while still being light weight.

Figure 2:
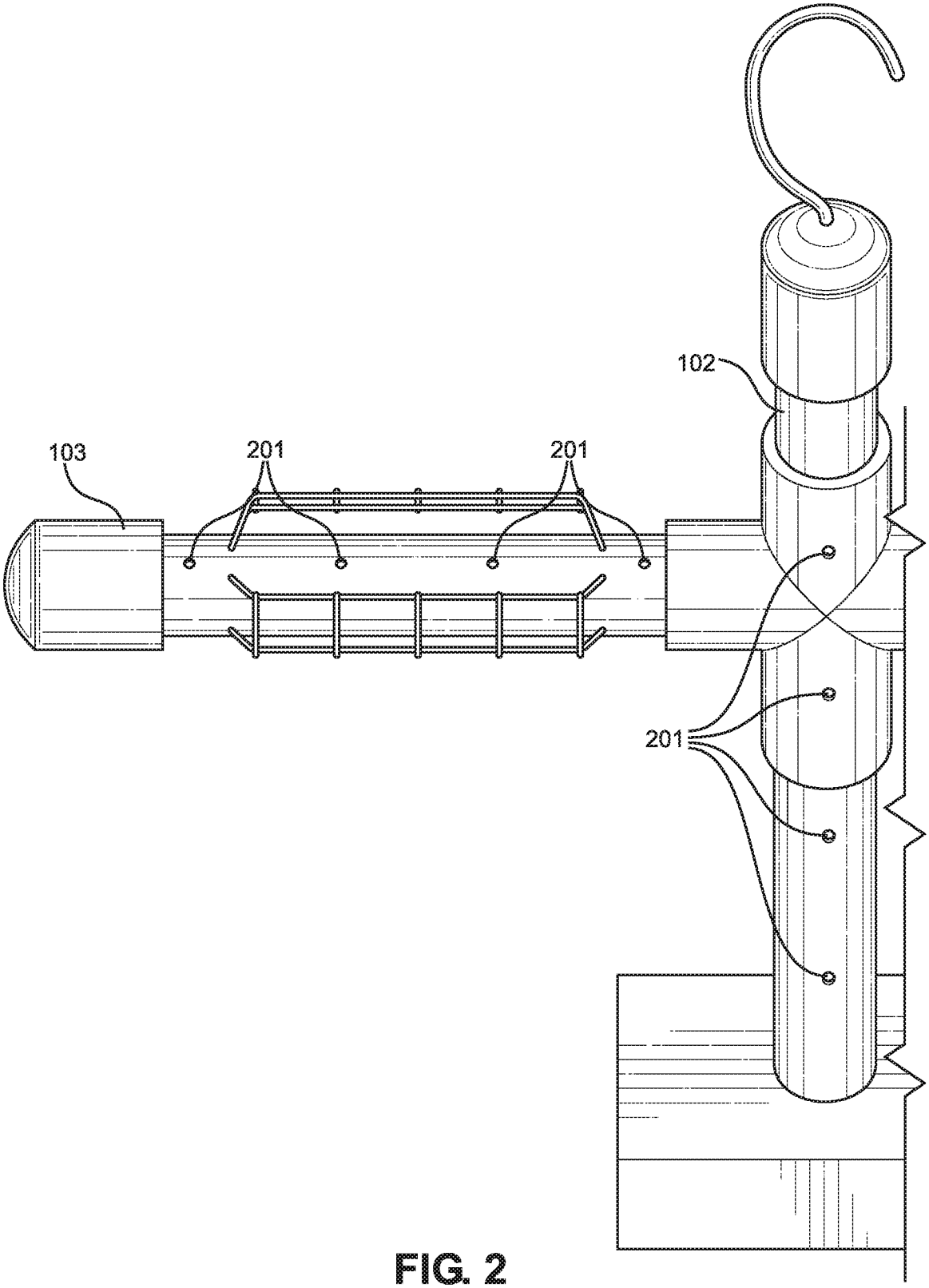
FIG. 2 shows a zoomed view of an embodiment of the shoulder pad drying and hanging device.

Referring now to FIG. 2, there is shown a zoomed view of an embodiment of the shoulder pad drying and hanging device. The shoulder pad hanging and drying device includes a plurality of apertures 201 in the cross supports 103 and the central support 102. The plurality of apertures 201 are air vents to allow air to be blown through the apertures 201 as described in FIG. 3. In the shown embodiment, the plurality of apertures 201 are in a linear pattern. Other patterns may be used as necessary to have the desired air flow. In different embodiments, the plurality of apertures 201 have different diameters.

Figure 3:
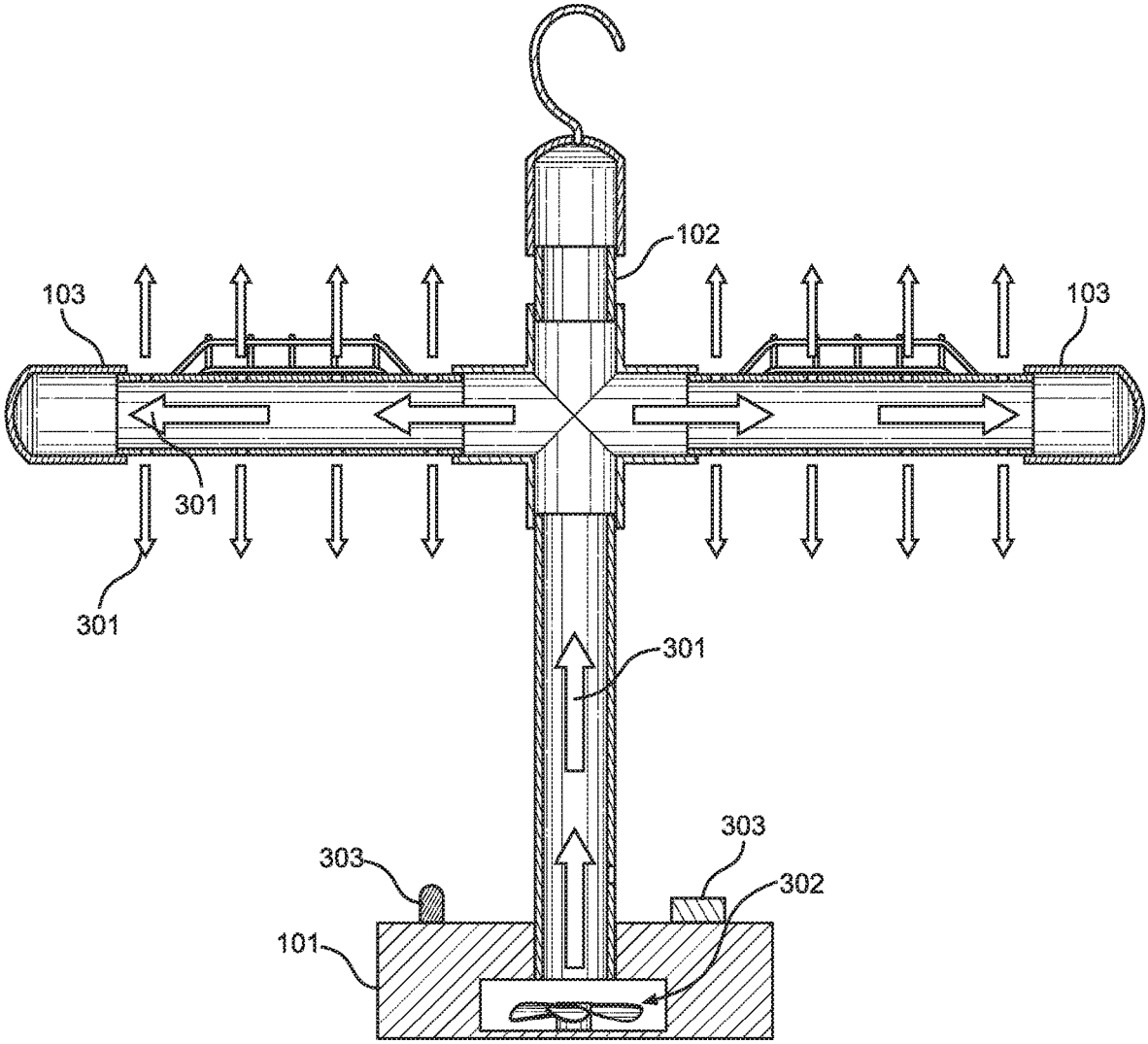
FIG. 3 shows a cross-sectional view of an embodiment of the shoulder pad drying and hanging device.

Referring now to FIG. 3, there is shown a cross-sectional view of an embodiment of the shoulder pad drying and hanging device. The central support 102 and the pair of cross supports 103 are hollow such that they allow air 301 to flow therethrough. It is important that the sidewalls of the central support 102 and the cross supports 103 are of a thickness to support a pair of sports shoulder pads.

In one embodiment there is a fan 302 located in the base 101. The fan 302 will force air 301 through the central support 102 and the pair of cross supports 103 and out of the plurality of apertures 201 to dry the shoulder pads. In one embodiment, the fan 302 has variable controls 303. In one embodiment, the controls 303 are located on the base 101 such that a user can select the desired fan settings. In one embodiment the fan settings include a high, medium, and low setting. In another embodiment the fan settings include an off and on setting. In one embodiment, the fan 302 has an internal power source. In one embodiment, the fan 302 has an external power source.

Figure 4:
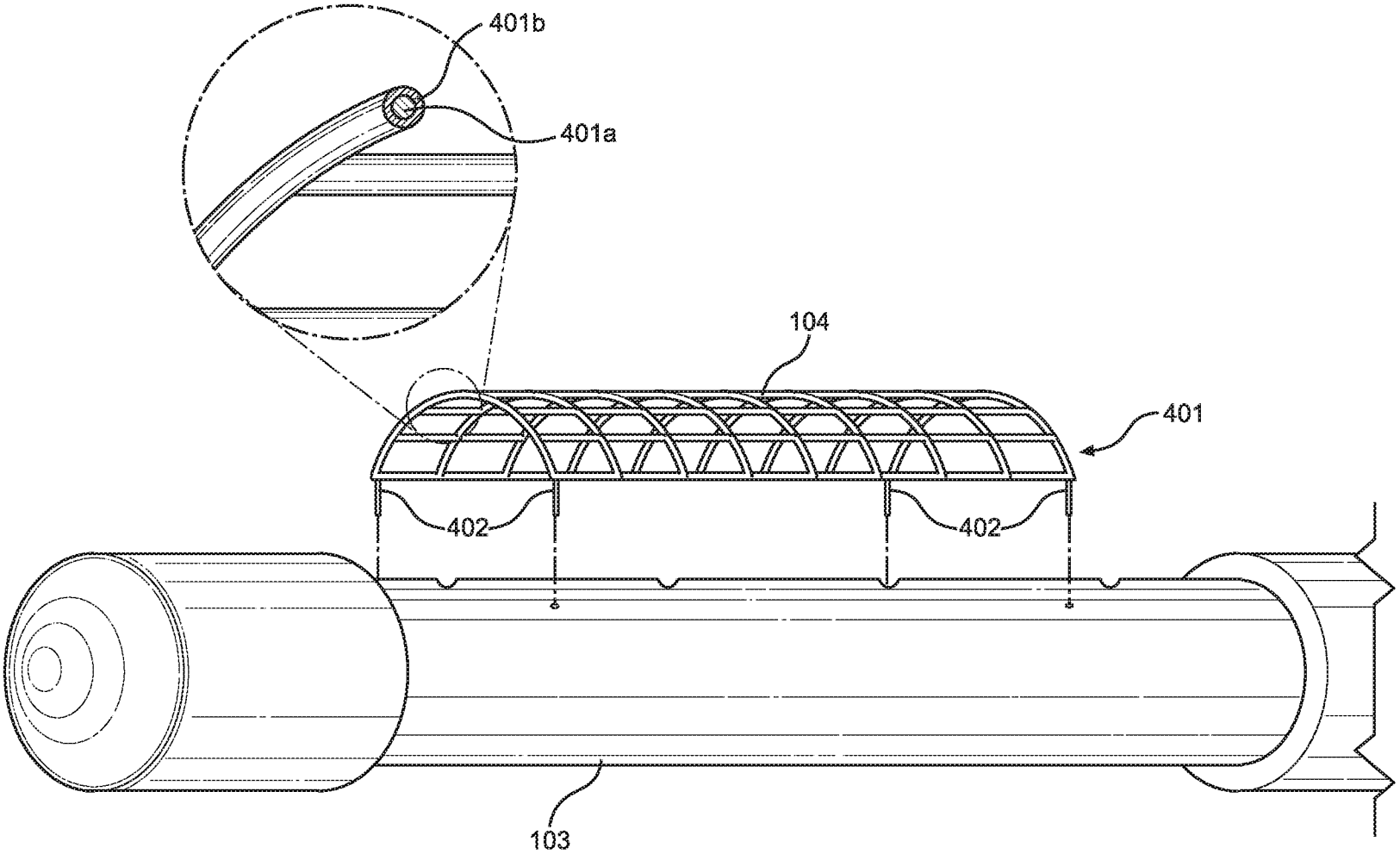
FIG. 4 shows a perspective view of an embodiment of the shoulder pad supports of the shoulder pad drying and hanging device.

Referring now to FIG. 4, there is shown a perspective view of an embodiment of the shoulder pat supports of the shoulder pad drying and hanging device. In one embodiment the pad support system 104 is comprised of a webbing 401. In the shown embodiment, the webbing 401 is arcuate as to match the contour of a pair of sports should pads. The webbing 401 is connected to each of the pair of cross supports 103 such that it is suspended therefrom by a plurality of supports 402. The webbing 401 will support a pair of shoulder pads above each of the pair of cross supports 103. While the webbing 401 is shown in a cross hatching of sorts, other designs may be placed in the webbing. In one embodiment, a spider web design may be used. In another embodiment, the name of a sports team may be used to create the webbing 401.

In one embodiment the webbing 401 is made from a stiff plastic. This will allow the device to be made as one continuous unit. In another embodiment the webbing 401 is made from a steel 401*a* coated in plastic 401*b*. This will allow the webbing 401 to have better durability. In one embodiment the webbing is moldable. This will allow the webbing to be bent to match different contours of shoulder pads.

Figure 5:
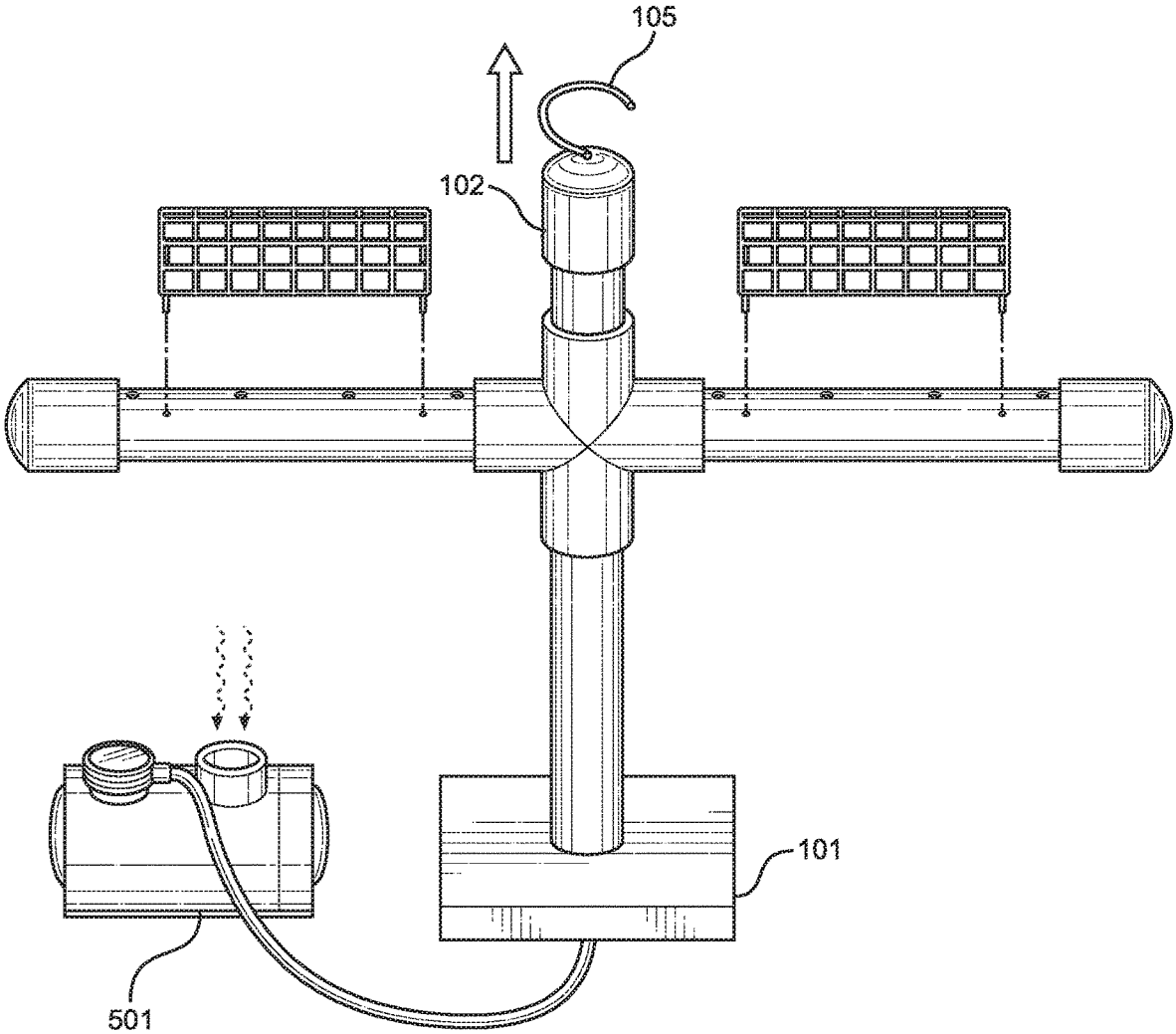
FIG. 5 shows a perspective view of an embodiment of the shoulder pad drying and hanging device laying on the side supported by the hook.

Referring now to FIG. 5, there is shown a perspective view of an embodiment of the shoulder pad drying and hanging device laying on the side supported by the hook. In one embodiment, the hook 105 is hingedly connected to the top of the central support 102. This will allow the hook 105 to bend from a plane parallel to the central support 102 to a plane perpendicular to the central support 102. In this manner the hook will act as a support leg when the device is placed on a side.

In the shown embodiment the base 101 has at least one planar side. The planar side of the base 101 will allow for the device to be placed on one side and prevent the device from rolling or tilting to one side. In this embodiment the hook 105 will support the other side of the device away from a surface. This embodiment will allow the device to be placed within a pair of sport shoulder pads that are positioned on their side. In one embodiment the base 101 has a fan located therein. In another embodiment the base is connected to an external air pump 501. In this embodiment a higher air pressure may be achieved. This embodiment may also allow for a central air pump to be used across multiple shoulder pad hanging and drying devices simultaneously.

Figure 6:
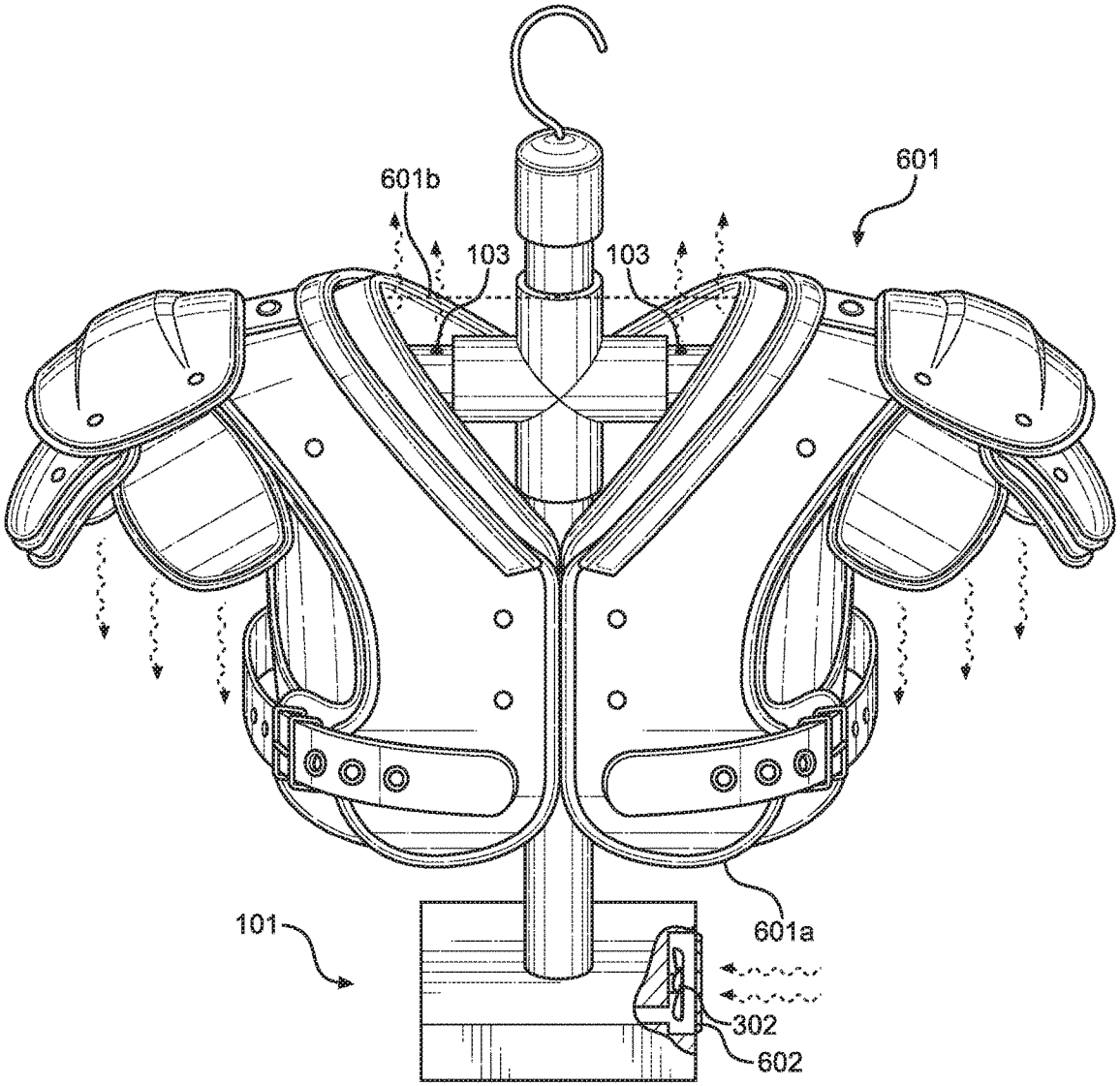
FIG. 6 shows a perspective in-use view of an embodiment of the shoulder pad drying and hanging device.

Referring now to FIG. 6, there is shown a perspective in use view of an embodiment of the shoulder pad drying and hanging device. In the shown embodiment the shoulder pad drying and hanging device is shown supporting a pair of football shoulder pads 601. The base 101 further comprises a cage 602. In the shown embodiment the cage 602 is domed. In other embodiment the cage 602 is other geometric shapes. The cage 602 has a dual purpose of supporting the device on a surface and at the same time allowing adequate air flow to be moved by the fan 302 through the device. This will allow air to be blown through the device no matter the positioning of the device will still protecting a user from the fan.

As explained in FIG. 1 the central support 101 is of a length that is longer than the football shoulder pads from a base 601*a* to the top of the neck opening 601*b*. Further, the pair of cross supports 103 are connected at a height that supports the football shoulder pads 601 above the base 101. This will allow the device to properly support and dry the football shoulder pads 601 or other forms of shoulder pads.

It is important to note that in many of the shown embodiments the parts of the shoulder pad drying and hanging device appear to be separate parts. This is in no way to be considered limiting except as where specifically stated. It is considered part of this disclosure that the shoulder pad hanging and drying device is made from a single part. It is also considered part of this disclosure that the materials may vary. Several materials have been detailed within this disclosure which will provide benefits to the present design but these are in no way limiting to the entirety of the disclosure.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoulder pad drying and hanging device, the device comprising:

a central support connected to a pair of cross supports extending from opposing sides of the central support, wherein the central support and the cross supports are hollow;

a pad support system secured to each of the pair of cross supports, wherein the pad support system will allow air to flow between the pad support system and the pair of cross supports;

at least one wire ladder structures located on each cross support, wherein each wire ladder structure comprises a pair of parallel longitudinal members and a plurality of lateral members extending between the longitudinal members;

a hook protruding from a top of the central support.

2. The shoulder pad drying and hanging device of claim 1, further comprising a series of apertures located through the central support and the pair of cross supports to allow air flow.

3. The shoulder pad drying and hanging device of claim 1, further comprising a fan secured to a bottom of the central support.

4. The shoulder pad drying and hanging device of claim 1, wherein the hook is hingedly connected to the central support.

5. The shoulder pad drying and hanging device of claim 1, wherein the pad support system is made from brass.

6. The shoulder pad drying and hanging device of claim 1, wherein the pad support system is made from steel coated in plastic.

7. The shoulder pad drying and hanging device of claim 2, further comprising a power source electrically coupled to the fan.

8. The shoulder pad drying and hanging device of claim 1, wherein the pad support system is a web configuration.

9. A shoulder pad drying and hanging device, the device comprising:

a central support connected to a pair of cross supports extending from opposing sides of the central support, wherein the central support and the cross supports are hollow;

a pad support system secured to each of the pair of cross supports, wherein the pad support system will allow air to flow between the pad support system and the pair of cross supports;

at least one wire ladder structures located on each cross support, wherein each wire ladder structure comprises a pair of parallel longitudinal members and a plurality of lateral members extending between the longitudinal members;

a hook protruding from a top of the central support a fan secured to the bottom of the central support, wherein a protective housing is located around the fan.

10. The shoulder pad drying and hanging device of claim 9, further comprising a series of apertures located through the central support and the pair of cross supports to allow air flow.

11. The shoulder pad drying and hanging device of claim 9, wherein the hook is hingedly connected to the central support.

12. The shoulder pad drying and hanging device of claim 9, wherein the pad support system is made from brass.

13. The shoulder pad drying and hanging device of claim 9, wherein the pad support system is made from steel coated in plastic.

14. The shoulder pad drying and hanging device of claim 9, further comprising a power source electrically coupled to the fan.

15. The shoulder pad drying and hanging device of claim 9, wherein the pad support system is a web configuration.

* * * * *